US007997223B2

(12) United States Patent
Bailey

(10) Patent No.: US 7,997,223 B2
(45) Date of Patent: Aug. 16, 2011

(54) VESSEL MOORING APPARATUS

(76) Inventor: Peter K. Bailey, Easton, MD (US)

( * ) Notice: Subject to any disclaimer, the term of this patent is extended or adjusted under 35 U.S.C. 154(b) by 232 days.

(21) Appl. No.: 12/396,719

(22) Filed: Mar. 3, 2009

(65) Prior Publication Data

US 2010/0227517 A1 Sep. 9, 2010

(51) Int. Cl.
*B63B 21/00* (2006.01)

(52) U.S. Cl. ..... 114/230.22; 114/230.23; 441/3

(58) Field of Classification Search ..... 114/230.22, 114/230.23, 230.24; 441/3, 25, 26
See application file for complete search history.

(56) References Cited

U.S. PATENT DOCUMENTS

| | | | | | |
|---|---|---|---|---|---|
| 345,268 | A * | 7/1886 | Wright | 114/230.23 |
| 1,621,809 | A * | 3/1927 | Petersen | 114/230.24 |
| 3,442,529 | A * | 5/1969 | Lewis et al. | 297/479 |
| 4,107,804 | A * | 8/1978 | Bennett | 441/24 |
| 4,195,380 | A * | 4/1980 | Higgs | 441/3 |
| 4,529,388 | A * | 7/1985 | Jones et al. | 441/3 |
| 4,778,422 | A * | 10/1988 | Saulnier et al. | 441/26 |
| 5,257,592 | A * | 11/1993 | Schaefer | 114/215 |
| 5,431,589 | A * | 7/1995 | Corona | 441/4 |
| 5,819,679 | A * | 10/1998 | Bonate et al. | 114/230.23 |
| 7,168,385 | B1 * | 1/2007 | Thomas | 114/230.23 |
| 7,325,509 | B2 | 2/2008 | Gordon et al. | |
| 7,891,309 | B2 * | 2/2011 | Driscoll et al. | 114/230.2 |
| 2006/0150883 | A1 * | 7/2006 | Gordon et al. | 114/230.23 |

* cited by examiner

*Primary Examiner* — Stephen Avila
(74) *Attorney, Agent, or Firm* — Wiley Rein LLP; Scott A. Felder

(57) ABSTRACT

A mooring buoy includes a buoyant shell that defines a chamber and has a channel extending from the chamber through the outer surface of the shell. The channel accommodates a pendant line therethrough. Within the chamber is a rotating takeup/payout that rotates about a drive axle and a drive mechanism coupled to the takeup/payout device that can drive the rotating takeup/payout device to rotate in a first direction to take up pendant line slack. The drive mechanism permits the takeup/payout device to rotate opposite the first direction in order to pay out pendant line under tension. Suitable takeup/payout devices include pulleys and spools. Suitable drive mechanisms include gravity-driven mechanisms, spring-driven mechanisms, and pendulum-driven mechanisms.

28 Claims, 6 Drawing Sheets

VESSEL MOORING APPARATUS

BACKGROUND OF THE INVENTION a. Field of the Invention

The instant invention relates to a vessel mooring apparatus. In particular, the instant invention relates to a mooring buoy including an assembly that automatically retracts a pendant line attached thereto when the pendant line is slack.

b. Background Art

A vessel mooring system generally includes four components: a mooring anchor, a mooring buoy, a connection between the mooring anchor and the mooring buoy, and a mooring pendant. The mooring anchor may be anything with sufficient weight to hold a moored vessel in place (e.g., an old engine block), but is typically an auger screwed into the water bottom or a mushroom anchor. Mooring buoys are often air-inflated PVC balls or conically shaped hard-shell foam-filled buoys. The mooring buoy functions as a floating platform to support the mooring anchor chain and as a platform to hold the mooring pendant for retrieval by a vessel using the mooring. The connection between the mooring anchor and the mooring buoy is often a metal chain.

The mooring pendant is a length of heavy line having one end connected to the mooring buoy and the other end available to connect to the vessel using the mooring. Often, when a vessel unmoors, the vessel's operator will simply toss the pendant line back into the water. Thus, over time, the pendant lines become coated with slime and other marine growth, such that, when the pendant line is brought aboard a vessel, the vessel and the vessel's operator may become quite dirty from handling the slimy pendant. It is also more difficult to retrieve a pendant line that is dangling in the water, as the free end of the pendant will likely be partially or totally beneath the surface of the water. In addition, a moored vessel can, with variations in current, wind, or waves, ride up on the mooring buoy, potentially damaging the hull of the moored vessel on the metal shackles used to attach the pendant line to the mooring buoy.

BRIEF SUMMARY OF THE INVENTION

It is therefore an object of the present invention to provide a vessel mooring apparatus that automatically retracts a pendant line when not attached to a vessel.

Another object of the present invention is to provide a vessel mooring apparatus that stores an unused pendant line in an easily retrieved position.

A further object of the present invention is to provide a vessel mooring apparatus that reduces the likelihood of damage to a moored vessel's hull.

Disclosed herein is a vessel mooring apparatus that includes: a buoyant shell defining a chamber and having a channel extending from the chamber through an outer surface of the buoyant shell, wherein the channel is configured to accommodate a pendant line therethrough; a rotating takeup/payout device positioned within the chamber and mounted to rotate about a drive axle; and a drive mechanism coupled to the rotating takeup/payout device, wherein the drive mechanism is operable to drive the rotating takeup/payout device to rotate about the drive axle in a first direction in order to take up pendant line slack while permitting the rotating takeup/payout device to rotate about the drive axle in a second direction opposite the first direction in order to pay out pendant line under tension. Preferably, the buoyant shell includes an upper portion and a lower portion, with the upper portion detachable from the lower portion to provide access to the chamber.

When the upper portion is attached to the lower portion, it encloses the chamber. The buoyant shell may also include at least one washout hole through the outer surface through which rainwater may enter and at least one drain hole through the outer surface through which it may exit.

To facilitate retrieval of the pendant line from the mooring buoy, the channel may extend through the sidewall of the outer surface of the buoyant shell proximate a scalloped portion. The scalloped portion allows the free end of the pendant line to hang away from the sidewall of the buoyant shell when fully taken up. Alternatively, where the channel extends through the top wall of the shell, the top wall of the shell may include a recess. The recess allows the free end of the pendant line to "nest" at least partially below the top edge of the buoyant shell when fully taken up. A moored vessel can be further protected from damage via the inclusion of an optional bumper surrounding at least a portion of the buoyant shell.

To connect a mooring (or anchor) line and a pendant line to the mooring buoy, the apparatus typically includes a dual-headed connector attached to the buoyant shell and having a first head within the chamber to receive the secure end of the pendant line and a second head outside the chamber to receive an end of a mooring anchor line. Preferably, at least one of the first head and the second head can swivel about a longitudinal axis of the dual-headed connector.

In some aspects of the invention, the rotating takeup/payout device includes a drive pulley mounted to rotate about the drive axle and having a circumferential groove configured to receive a pendant line. The rotating takeup/payout device may also include an idle pulley positioned adjacent the drive pulley and mounted to rotate about an idle axle, the idle pulley having a circumferential groove configured to receive a pendant line. Preferably, a lateral distance between the drive axle and the idle axle is adjustable such that a pendant line can be tightly and snugly received between the circumferential groove of the drive pulley and the circumferential groove of the idle pulley.

In other aspects of the invention, the rotating takeup/payout device includes a spool mounted to rotate about the drive axle and about which a pendant line may be wound and unwound. Preferably, the spool includes a pass-through slot configured to accommodate a pendant line therethrough. This permits the spool to be unloaded when the pendant line is fully paid out under tension.

According to some embodiments of the invention, the drive mechanism stores energy as the pendant line is paid out under tension and utilizes the stored energy to drive the rotating takeup/payout device in the first direction when the pendant line is slack. For example, the drive mechanism may include a power spring coupled to the rotating takeup/payout device such that the power spring is wound as the rotating takeup/payout device rotates in the second direction. Alternatively, the drive mechanism may include a counterweight coupled to the rotating takeup/payout device such that the counterweight is raised as the rotating takeup/payout device rotates in the second direction. The counterweight may optionally travel through a protective tube that extends downwardly from the buoyant shell and/or upwardly into the chamber of the buoyant shell. It is also desirable for the protective tube to be rotatably coupled to the buoyant shell, in particular where the protective tube extends downwardly from the buoyant shell.

In other embodiments of the invention, the drive mechanism operates neutrally as the pendant line is paid out under tension and utilizes motion of the mooring buoy to drive the rotating takeup/payout device in the first direction when the pendant line is slack. For example, the drive mechanism may include: a rotating ratchet gear coupled to the rotating takeup/payout device such that the rotating takeup/payout device rotates with the rotating ratchet gear and including a plurality of teeth; a pendulum having an upper end and a weighted, lower end; and a pawl coupled to the upper end of the pendulum and configured to be alternately engaged with and disengaged from the teeth of the rotating ratchet gear. The teeth of the rotating ratchet gear are oriented such that, when the pawl is engaged with the teeth of the rotating ratchet gear, pendulum motion causes the rotating ratchet gear to drive the rotating takeup/payout device in the first direction.

In order for the drive mechanism to operate neutrally as the pendant line is paid out under tension, the drive mechanism typically includes a tripping mechanism that disengages the pawl from the rotating ratchet gear when a pendant line attached to the rotating takeup/payout mechanism has been fully taken up and that reengages the pawl with the rotating ratchet gear when the pendant line is fully paid out under tension. It is also contemplated that the tripping mechanism may disengage the pawl from the rotating ratchet gear whenever the pendant line is under tension and reengage the pawl with the rotating ratchet gear whenever the pendant line is slack.

In another aspect, the present invention provides a system for mooring a vessel including a mooring buoy and a pendant line. The mooring buoy includes a buoyant shell defining a chamber and having a channel extending from the chamber through an outer surface of the buoyant shell; a rotating takeup/payout device positioned within the chamber and mounted to rotate about a drive axle; and a drive mechanism coupled to the rotating takeup/payout device. The drive mechanism is operable to drive the rotating takeup/payout device to rotate about the drive axle in a first direction while permitting the rotating takeup/payout device to rotate about the drive axle in a second direction opposite the first direction. The pendant line has a first end attached to the buoyant shell, a length extending through the rotating takeup/payout device and the channel, and a second, free end outside the channel configured to attach to a vessel. When the rotating takeup/payout device is driven to rotate in the first direction, the pendant line is taken up by the rotating takeup/payout device. When the rotating takeup/payout device rotates in the second direction, the pendant line is paid out by the rotating takeup/payout device. In some embodiments of the invention, the pendant line is swivelably attached to the buoyant shell. The system may also include a mooring anchor and a mooring line/chain coupling the mooring anchor to the mooring buoy.

Also disclosed herein is a vessel mooring apparatus that includes: a buoyant shell defining a chamber and having a channel extending from the chamber through an outer surface of the buoyant shell, wherein the channel is configured to accommodate a pendant line therethrough; a rotating takeup/payout device located within the chamber and mounted to rotate about a drive axle in a first direction corresponding to pendant line takeup and a second, opposite direction corresponding to pendant line payout; and a drive mechanism coupled to the rotating takeup/payout device, wherein the drive mechanism stores energy when the rotating takeup/payout device rotates in the second direction to payout pendant line under tension and utilizes the stored energy to drive the rotating takeup/payout device in the first direction to take up pendant line slack.

An advantage of a vessel mooring apparatus according to the present invention is that it keeps the pendant line clean by automatically retracting an unused pendant line into the interior of the mooring buoy, thereby keeping it out of the water.

Another advantage of a vessel mooring apparatus according to the present invention is that it keeps the free end of the pendant line in an easily retrieved position adjacent the mooring buoy.

Still another advantage of a vessel mooring apparatus according to the present invention is that it need not include potentially damaging metal shackles exterior to the mooring buoy.

Yet a further advantage of a vessel mooring apparatus according to the present invention is that it stores an unused pendant line out of the elements.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
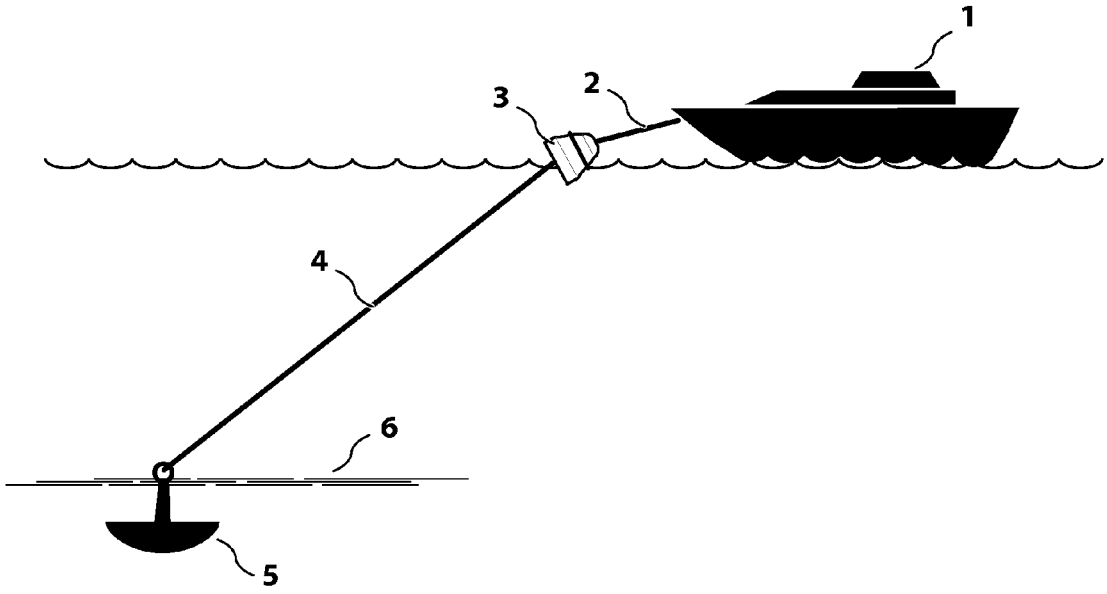
FIG. 1 schematically illustrates a moored vessel.

FIG. 1 schematically depicts a vessel 1 attached via a pendant line 2 to a mooring buoy 3 according to the present invention. One end of pendant line 2 (referred to herein as the "secure end") is affixed to mooring buoy 3 (for example, as described in detail below), while the other end thereof (referred to herein as the "free end") is attached to vessel 1. It should be understood that pendant line 2 may be attached to vessel 1 in any suitable fashion. For example, the free end of pendant line 2 may include a loop or spliced eye (see FIG. 2) that is placed around a cleat attached to the hull or deck of vessel 1.

An anchor line or chain 4 (e.g., a metal chain) extends from mooring buoy 3 to a mooring anchor 5. Mooring anchor 5 is illustrated as a mushroom anchor embedded in water bottom 6. One of ordinary skill in the art will appreciate, however, that any suitable combination of anchor line 4 and mooring anchor 5 may be utilized without departing from the present teachings.

Figure 2:
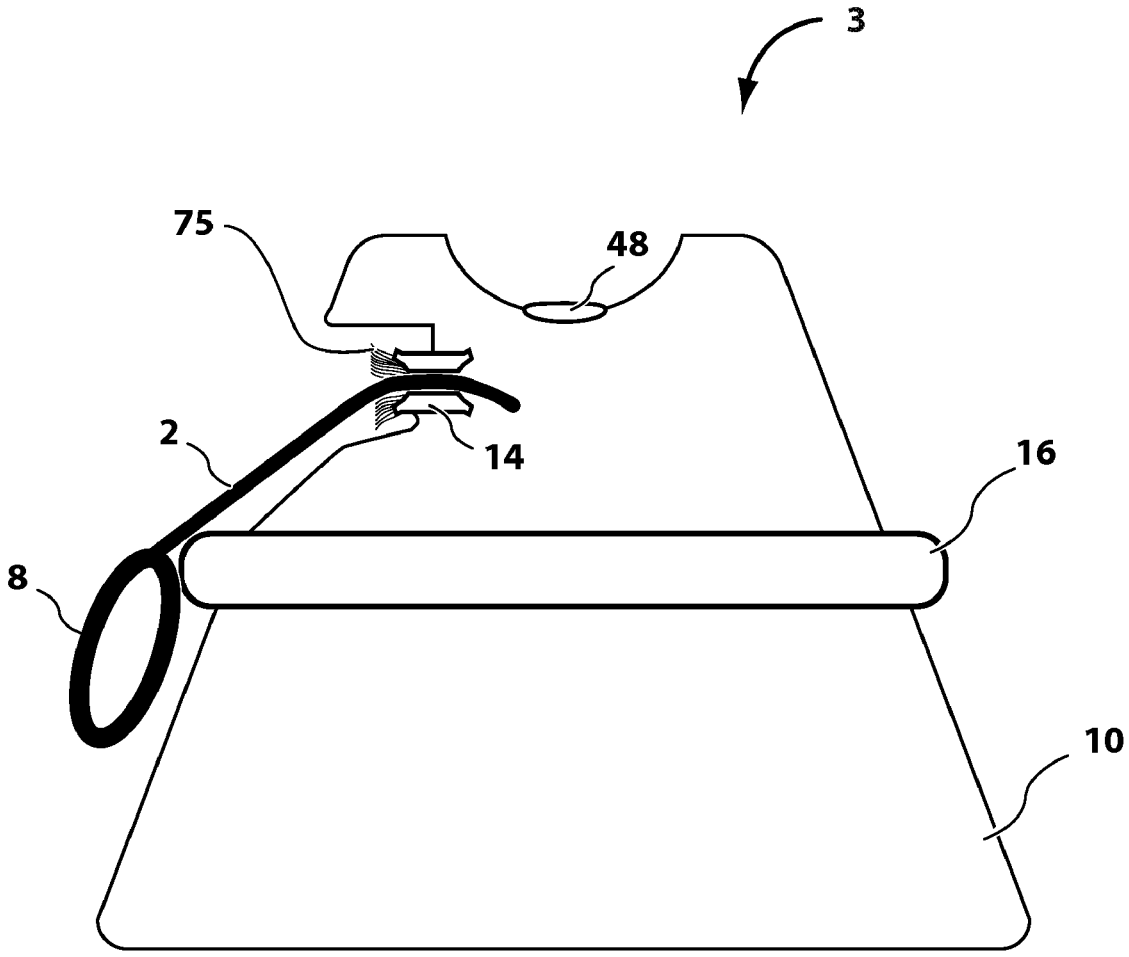
FIG. 2 depicts a mooring buoy and illustrates certain aspects of the present invention.

FIG. 2 depicts certain features of mooring buoy 3 and pendant line 2. As seen in FIG. 2, the free end of pendant line 2 may include a loop 8 that allows pendant line 2 to be attached to a moored vessel. Mooring buoy 3 generally includes a buoyant shell 10 that defines a chamber 12 (visible, for example, in FIGS. 3 and 6). Suitable materials for buoyant shell 10 include, but are not limited to, foam-filled plastic materials.

A channel 14 extends from chamber 12 through an outer surface of buoyant shell 10 and is sized to accommodate pendant line 2 therethrough. Channel 14 may emerge through the side of buoyant shell 10, as depicted in FIG. 2, or, alternatively, through the top of buoyant shell 10, as depicted in FIG. 6.

To further reduce the likelihood of damage to the hull of a moored vessel, a bumper 16 (e.g., a life-ring type fender) may surround all or part of buoyant shell 10. Bumper 16 also advantageously sets loop 8 off from the outer surface of buoyant shell 10, making pendant line 2 more easily grasped by a vessel's operator (e.g., snagged with a boat hook). It is also contemplated that buoyant shell 10 may be made reflective to aid in visibility, for example by molding a reflective material into buoyant shell 10 or placing reflective tape thereon.

Figure 3:
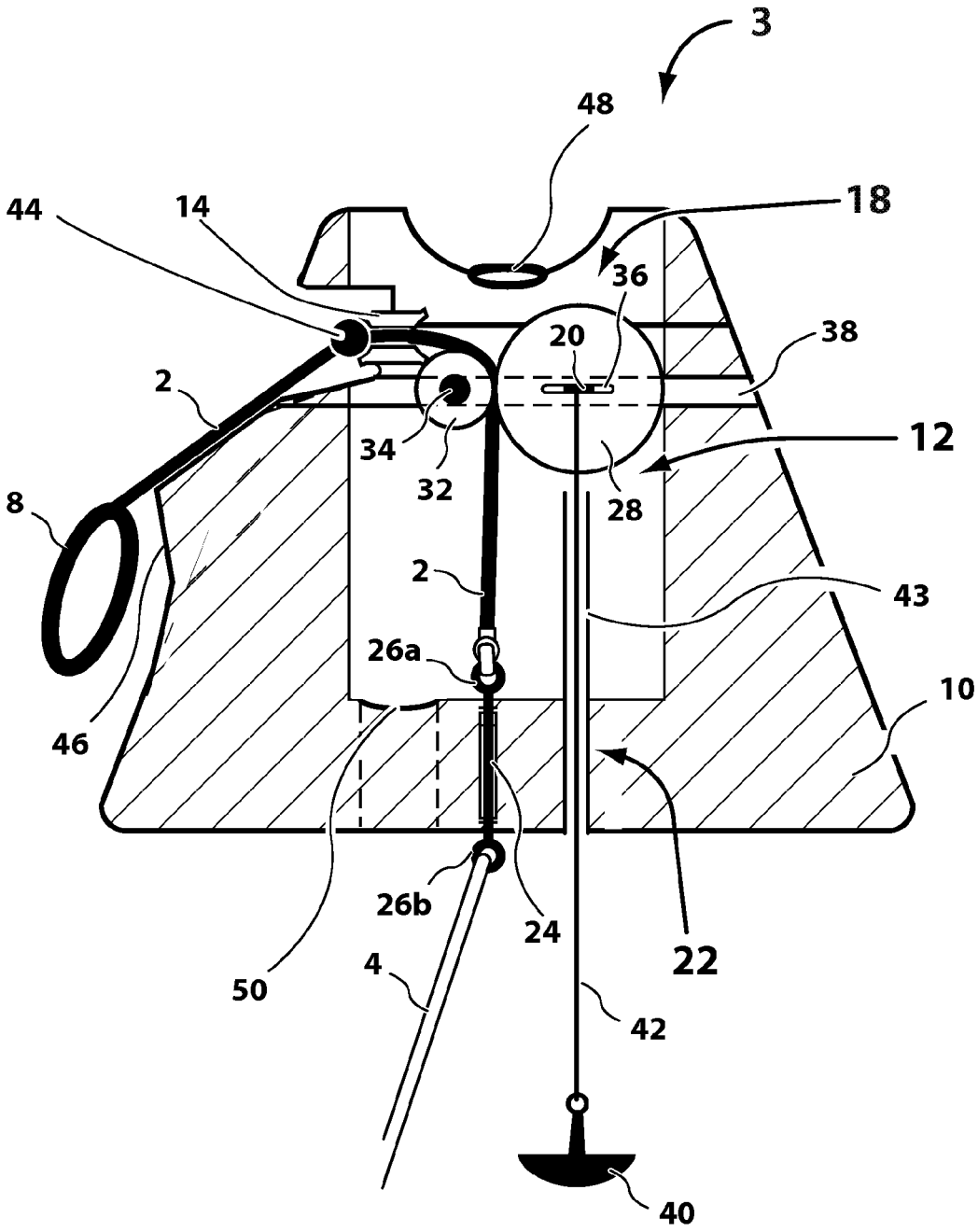
FIG. 3 is a cutaway view of a mooring buoy according to an embodiment of the present invention including a pulley-based takeup/payout device and a counterweight-based drive mechanism.
Figure 6:
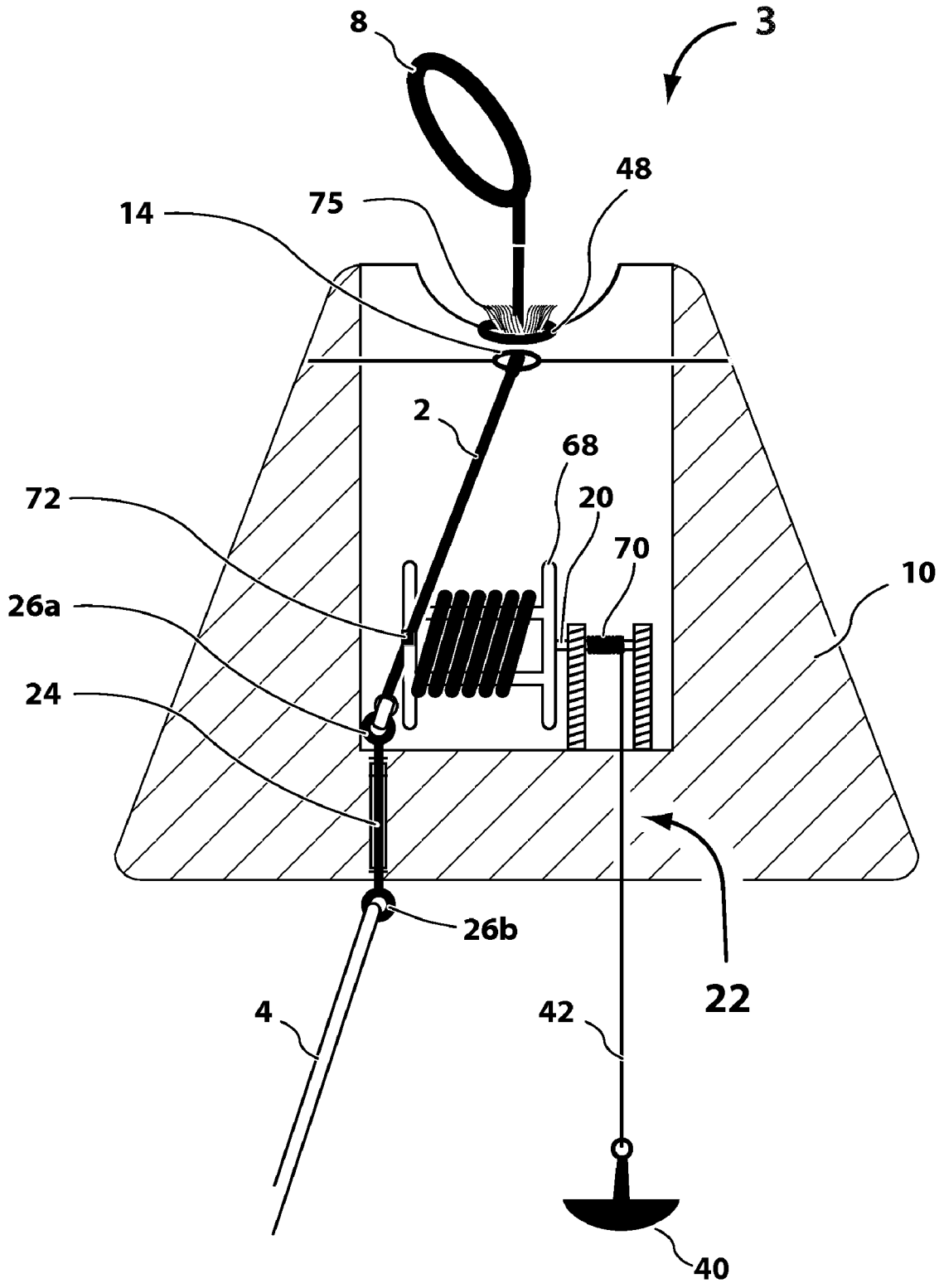
FIG. 6 is a cutaway view of a mooring buoy according to another embodiment of the present invention including a spool (or reel) based takeup/payout device and a counterweight-based drive mechanism.

As illustrated to good advantage in FIGS. 3 and 6, a rotating takeup/payout device 18 is positioned within chamber 12 and mounted to rotate about a drive axle 20. Coupled to the rotating takeup/payout device 18 is a drive mechanism 22, which is operable to drive rotating takeup/payout device 18 to rotate about drive axle 20 in a first direction in order to take up slack in pendant line 2 while permitting rotating takeup/payout device 18 to rotate about drive axle 20 in a second direction opposite the first direction in order to pay out pendant line 2 under tension. Various rotating takeup/payout devices and drive mechanisms will be described in further detail below.

As also seen in FIG. 3, the secure end of pendant line 2 is attached to mooring buoy 3 via a dual-headed connector 24 (e.g., an eye bolt) attached to buoyant shell 10. One head 26*a* of connector 24 is positioned within chamber 12 such that the secure end of pendant line 2 can be attached thereto. The other head 26*b* of connector 24 is positioned outside of chamber 12 so that anchor line 4 can be attached thereto. In some embodiments of the invention, such as those employing a spool assembly as the rotating takeup/payout device 18, at least one of head 26*a* and head 26*b* can swivel about a longitudinal axis of connector 24, though other means and methods of attaching pendant line 2 and anchor line 4 to mooring buoy 3 are contemplated and regarded as within the spirit and scope of the present invention.

In certain preferred embodiments of the invention, rotating takeup/payout device 18 is a pulley assembly 27 (FIG. 4B) that includes a drive pulley 28 mounted to rotate about drive axle 20 and an idle pulley 32 mounted to rotate about an idle axle 34. Drive pulley 28 includes a circumferential groove 30 (FIG. 4A) configured to receive pendant line 2. Idle pulley 32 includes a similar circumferential groove. Preferably, the lateral distance between drive axle 20 and idle axle 34 is adjustable so as to closely receive pendant line 2 between the two circumferential grooves as shown in FIG. 4B. This may be accomplished, for example, by slidably mounting either or both of drive pulley 28 and idle pulley 32 on a mounting bracket 38 via the use of a slot 36 (FIG. 3) in either or both of drive pulley 28 and idle pulley 32. The faces of the grooves may optionally be coated with a non-skid surface to increase friction against pendant line 2.

In the embodiment of the invention depicted in FIG. 3, drive mechanism 22 is counterweight-based and includes a counterweight 40 coupled to rotating takeup/payout device 18 (e.g., pulley assembly 27, and in particular drive pulley 28) via a counterweight line 42. As pendant line 2 is paid out under tension, drive pulley 28 rotates in the second direction (e.g., clockwise as illustrated in FIGS. 3 and 4B), which raises counterweight 40 and stores gravitational potential energy. Conversely, when pendant line 2 is slack (e.g., when pendant line 2 is dropped in the water when a vessel unmoors), counterweight 40 drops, releasing the stored potential energy and driving takeup/payout mechanism 18 (e.g., drive pulley 28) in the first direction (e.g., counterclockwise as illustrated in FIGS. 3 and 4B), thereby taking pendant line up into chamber 12.

Counterweight 40 may be of any suitable size, shape, and weight. Of course, it is desirable for counterweight 40 to be sufficiently heavy to provide sufficient force to engage drive mechanism 22 to rotate takeup/payout device 18, yet sufficiently light that it does not impair the buoyancy of mooring buoy 3. Likewise, counterweight line 42 may be of any suitable length to ensure that pendant line 2 is fully taken up into chamber 12 when slack. The ordinary artisan will appreciate how to appropriately select and arrange counterweight 40 and counterweight line 42 in accordance with the teachings herein.

To protect counterweight 40 and counterweight line 42 from interference, a protective tube 43 may be provided for counterweight 40 and/or counterweight line 42 to travel through. Several arrangements of protective tube 43 are contemplated. For example, protective tube 43 may extend downwardly from buoyant shell 10, thereby protecting counterweight 40 and counterweight line 42 from becoming entangled with anchor line 4. Protective tube 43 may also extend upwardly into chamber 12, thereby protecting counterweight 40 and counterweight line 42 from becoming entangled with pendant line 2. Where protective tube 43 extends downwardly from buoyant shell 10, it is desirable to rotatably couple protective tube 43 to buoyant shell 10, for example via a ball-and-socket joint, to guard against potentially damaging forces as mooring buoy 3 is tilted/rotated under tension.

As seen in FIG. 3, in certain aspects of the invention, a stopping ball 44, which has dimensions exceeding those of channel 14, may be provided on pendant line 2 at a location that allows a desirable length of pendant line 2 to remain outside of chamber 12 when pendant line 2 is fully taken up. Where channel 14 is in the sidewall of buoyant shell 10, a scalloped portion 46 may be provided such that the free end of pendant line 2 hangs away from the sidewall of buoyant shell 10 when fully taken up. Alternatively, where channel 14 is in the top wall of buoyant shell 10, the top wall of the buoyant shell 10 may be recessed such that the free end of pendant line 2 "nests" below the top edge of buoyant shell 10 when fully taken up (illustrated in FIG. 6). These configurations are desirable in that they ease retrieval of pendant line 2. The recess in the top wall of buoyant shell 10 also serves as a reservoir for washout hole 48.

To clean out chamber 12 and rinse pendant line 2, takeup/payout device 18, and drive mechanism 22, buoyant shell 10 may include at least one washout hole 48 extending upwardly from chamber 12 through the outer surface of buoyant shell 10 and at least one drain hole 50 extending downwardly from chamber 12 through the outer surface of buoyant shell 10. Rainwater can enter chamber 12 via washout hole(s) 48 and exit via drain hole(s) 50. It should be understood that the use of the terms "upwardly" and "downwardly" in connection with washout hole(s) 48 and drain hole(s) 50 are not limited to perfectly vertical orientations and are used to connote any arrangement that permits rainwater to enter chamber 12 via washout hole(s) 48 and exit chamber 12 via drain hole(s) 50.

It is also contemplated that buoyant shell 10 may include an upper portion and a lower portion, with the upper portion being removable from the lower portion to provide service access to chamber 12. When service is complete, the upper portion may be reattached to the lower portion in order to enclose chamber 12.

Figure 4A:
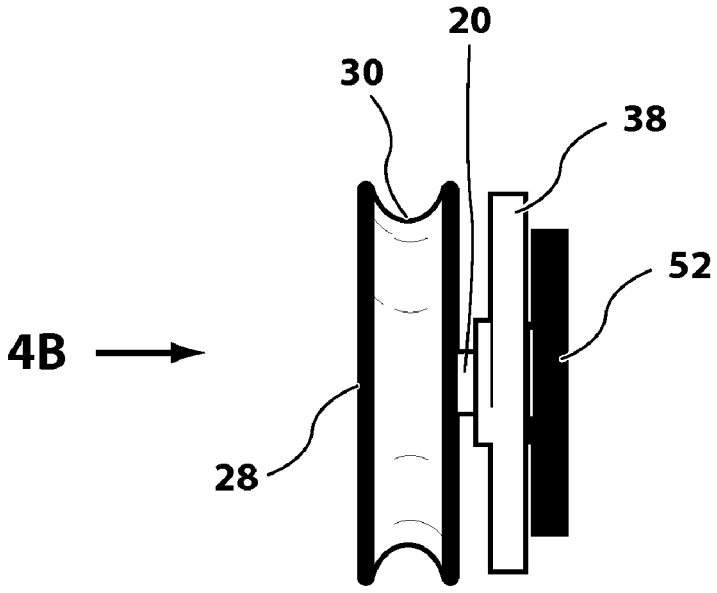
FIG. 4A depicts a pulley-based takeup/payout device and power spring drive mechanism according to some embodiments of the present invention.
Figure 4B:
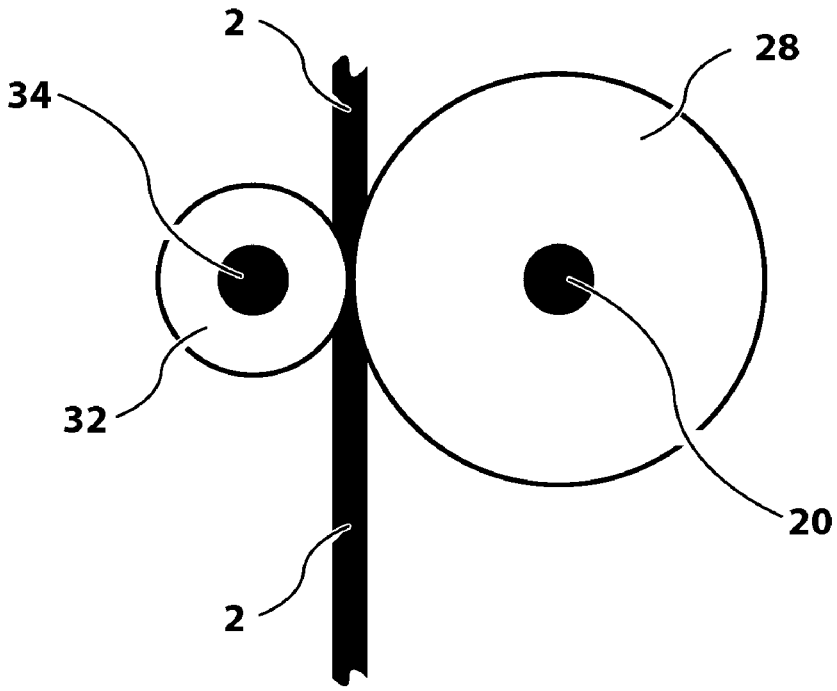
FIG. 4B is a view looking along arrow 4B in FIG. 4A.

FIG. 4A illustrates a second drive mechanism used in certain preferred embodiments of the invention. The alternative drive mechanism depicted in FIG. 4A includes a fully enclosed power spring 52 coupled to takeup/payout device 18. Power spring 52 is similar to a watch main spring in that it stores energy as it is wound. For example, as pendant line 2 is paid out under tension, drive pulley 28 rotates in the second direction (e.g., clockwise), winding power spring 52 and storing spring potential energy therein. When pendant line is slack (e.g., when it is dropped in the water after a vessel unmoors), power spring 52 unwinds, releasing the stored energy to drive pulley 28 in the first direction (e.g., counterclockwise) to take up pendant line 2. The ordinary artisan will appreciate how to select an appropriate power spring 52 in accordance with the teachings herein.

Figure 5A:
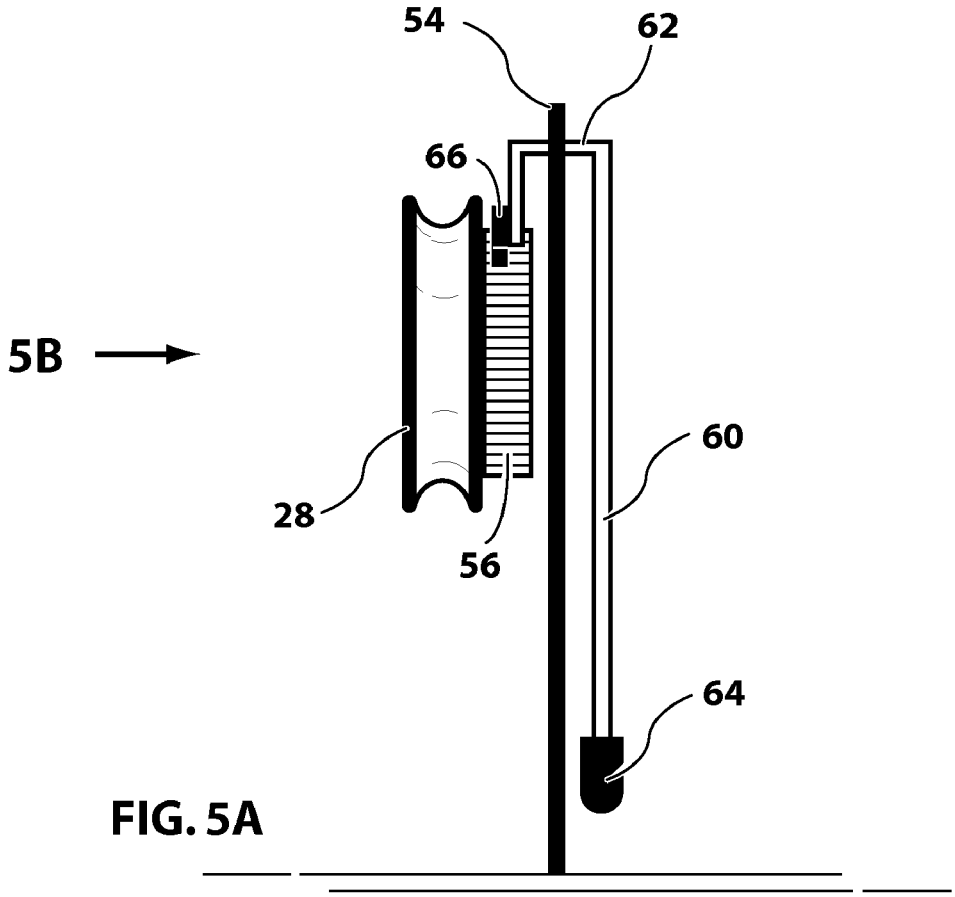
FIG. 5A depicts a pulley-based takeup/payout device and a ratchet and pendulum drive mechanism according to another aspect of the present invention.
Figure 5B:
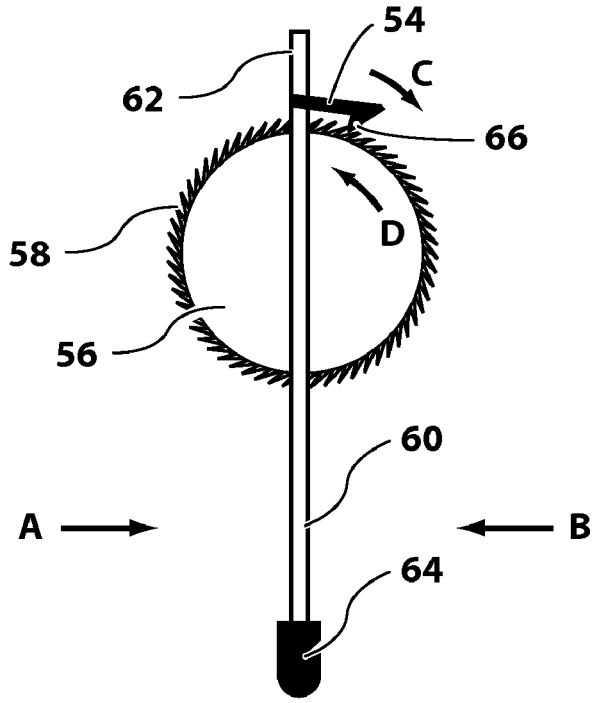
FIG. 5B is a view looking along line 5B in FIG. 5A.

Still another drive mechanism, including a ratchet and pendulum assembly 54, is illustrated in FIGS. 5A and 5B in conjunction with pulley assembly 27. Ratchet and pendulum assembly 54 includes a rotating ratchet gear 56 including a plurality of teeth 58. Ratchet gear 56 is coupled to takeup/payout device 18 (e.g., drive pulley 28) such that takeup/payout device 18 rotates with ratchet gear 56. This coupling may be direct, as illustrated in FIG. 5A, or indirect (e.g., via a gear train). Ratchet and pendulum assembly 54 also includes a pendulum 60 having an upper end 62 and a lower, weighted end 64. Weighted end 64 may extend out of a lower surface of buoyant shell 10 (e.g., into the water). A pawl 66 is coupled to upper end 62 of pendulum 60 and is configured to be alternately engaged with and disengaged from teeth 58.

Teeth 58 are oriented such that, when pawl 66 is engaged therewith, motion of pendulum 60 (due, for example, to current, wind, or waves moving mooring buoy 3) causes ratchet gear 56 to drive takeup/payout device 18 (e.g., drive pulley 28) to rotate in the first direction (e.g., counterclockwise), thereby taking up pendant line 2. For example, as illustrated in FIG. 5B, when pendulum 60 swings in the direction of arrow "B," pawl 66 will slide freely over teeth 58 in the direction of arrow "C" without rotating ratchet gear 56. When pendulum 60 reverses and swings in the direction of arrow "A," pawl 66 will catch in teeth 58, driving ratchet gear 58 in the direction of arrow "D," thereby rotating takeup/payout device 18 in the first direction to take up pendant line 2. The teachings herein will allow an ordinary artisan to configure an appropriate ratchet and pendulum assembly.

In order for ratchet gear 56 to operate in neutral to pay out pendant line 2 under tension, ratchet and pendulum assembly 54 preferably includes a tripping mechanism that disengages pawl 66 from and reengages pawl 66 with ratchet gear 56. In some embodiments of the invention, the tripping mechanism operates to disengage pawl 66 from ratchet gear 56 when pendant line 2 has been fully taken up (e.g., stopping ball 44 is at channel 14) and to reengage pawl 56 with ratchet gear 56 when pendant line 2 is fully paid out. In other embodiments of the invention, the tripping mechanism operates to disengage pawl 66 from ratchet gear 56 whenever pendant line 2 is under tension and to reengage pawl 56 with ratchet gear 56 whenever pendant line 2 is slack.

In some embodiments of the invention, when pendant line 2 is fully taken up, stopping ball 44 may trip a switch adjacent channel 14 on the outer surface of buoyant shell 10 that disengages pawl 66 from ratchet gear 56. A second stopping ball can be provided on pendant line 2 closer to the secure end of pendant line 2 in order to trip a complementary switch adjacent channel 14 within chamber 12 that reengages pawl 66 and ratchet gear 56 when pendant line 2 is fully paid out. The position of the second stopping ball, of course, determines the length at which pendant line 2 is fully paid out. Alternatively, the tripping mechanism may be a spring-loaded mechanism within channel 14 that is tripped to disengage pawl 66 from ratchet gear 56 whenever pendant line is in tension (e.g., paying out) and tripped to engage pawl 66 with ratchet gear 56 when pendant line 2 is slack (e.g., dropped in the water after a vessel unmoors).

FIG. 6 illustrates an alternative takeup/payout device 18 according to additional aspects of the present invention. The takeup/payout device of FIG. 6 includes a spool 68 mounted to rotate about drive axle 20 and about which pendant line 2 may be wound (e.g., when being taken up) and unwound (e.g., when being paid out). A second spool 70 is provided about which counterweight line 42 may be wound and unwound as counterweight 40 is raised and lowered. Spool 68 and spool 70 rotate together such that, as pendant line 2 is paid out, counterweight 40 is raised to store gravitational potential energy, and, when pendant line 2 is slack, counterweight 40 drops, using the stored potential energy to rotate spools 70, 68 and wind pendant line 2 about spool 68. Of course, it is contemplated that power spring 52 or ratchet and pendulum assembly 54 could be employed to drive spool 68 instead according to the teachings herein.

Spool 68 preferably includes a pass-through slot 72 that can accommodate pendant line 2 therethrough. The secure end of pendant line 2 is attached to connector 24 at head 26*b*. From head 26*b*, pendant line passes through the open end of spool 68, through pass through slot 72, and then through channel 14 to the outside of buoyant shell 10. When pendant line 2 is fully paid out under tension (e.g., when there are no windings of pendant line 2 about spool 68), pass through slot 72 allows spool 68 to be unloaded. That is, when pendant line 2 is fully paid out, the load on pendant line 2 is borne by buoyant shell 10 (via head 26*a* of connector 24) rather than spool 68. Moreover, as shown in FIG. 1, with channel 14 in the top wall of buoyant shell 10, mooring buoy 3 tilts towards vessel 1 such that pendant 2 and anchor line 4 are in a substantially straight line.

As one of ordinary skill in the art will recognize, when pendant line 2 is attached to a moored vessel, seaweed and other debris on the surface of the water may accumulate on pendant line 2. It is desirable to prevent this debris from entering chamber 12 when pendant line 2 is taken up. Accordingly, in some embodiments of the invention, a bristle brush 75, visible in FIGS. 2 and 6, is provided about the opening of channel 14. As pendant line 2 is taken up, bristle brush 75 removes debris therefrom, preventing it from entering chamber 12.

Although several embodiments of this invention have been described above with a certain degree of particularity, those skilled in the art could make numerous alterations to the disclosed embodiments without departing from the spirit or scope of this invention. For example, the various rotating takeup/payout devices (e.g., the pulley assembly and the spool assembly) and drive mechanisms (e.g., the counterweight, the power spring, and the ratchet and pendulum assembly) disclosed herein can be used in any combination. Similarly, other drive mechanisms (e.g., motors) may be employed without departing from the spirit and scope of the present invention.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A vessel mooring apparatus, comprising:

a buoyant shell defining a chamber and having a channel extending from the chamber through an outer surface of the buoyant shell, wherein the channel is configured to accommodate a pendant line therethrough;

a rotating takeup/payout device positioned within the chamber and mounted to rotate about a drive axle; and a drive mechanism coupled to the rotating takeup/payout device, wherein the drive mechanism utilizes stored potential energy to drive the rotating takeup/payout device to rotate about the drive axle in a first direction in order to take up pendant line slack and stores potential energy when the rotating takeup/payout device is rotated about the drive axle in a second direction opposite the first direction in order to pay out pendant line under tension.

2. The apparatus according to claim 1, wherein the rotating takeup/payout device comprises a drive pulley mounted to rotate about the drive axle and having a circumferential groove configured to receive a pendant line.

3. The apparatus according to claim 2, wherein the rotating takeup/payout device further comprises an idle pulley positioned adjacent the drive pulley and mounted to rotate about an idle axle, the idle pulley having a circumferential groove configured to receive a pendant line.

4. The apparatus according to claim 3, wherein a lateral distance between the drive axle and the idle axle is adjustable such that a pendant line can be received between the circumferential groove of the drive pulley and the circumferential groove of the idle pulley.

5. The apparatus according to claim 1, wherein the rotating takeup/payout device comprises a spool mounted to rotate about the drive axle and about which a pendant line may be wound and unwound.

6. The apparatus according to claim 5, wherein the spool includes a pass-through slot configured to accommodate a pendant line therethrough such that, when the pendant line is fully paid out under tension, the spool is unloaded.

7. The apparatus according to claim 1, wherein the drive mechanism comprises a power spring coupled to the rotating takeup/payout device such that the power spring is wound to store energy as the rotating takeup/payout device rotates in the second direction.

8. The apparatus according to claim 1, wherein the drive mechanism comprises a counterweight coupled to the rotating takeup/payout device such that the counterweight is raised to store energy as the rotating takeup/payout device rotates in the second direction.

9. The apparatus according to claim 8, further comprising a protective tube extending downwardly from the buoyant shell within which the counterweight travels.

10. The apparatus according to claim 9, wherein the protective tube is rotatably coupled to the buoyant shell.

11. The apparatus according to claim 9, wherein an upper portion of the protective tube extends within the chamber of the buoyant shell.

12. The apparatus according to claim 1, wherein the buoyant shell comprises an upper portion and a lower portion, and wherein the upper portion can be detached from the lower portion to provide access to the chamber of the buoyant shell and reattached to the lower portion to enclose the chamber of the buoyant shell.

13. The apparatus according to claim 1, wherein the buoyant shell includes at least one drain hole extending downwardly from the chamber through the outer surface.

14. The apparatus according to claim 13, wherein the buoyant shell includes at least one washout hole extending upwardly from the chamber through the outer surface.

15. The apparatus according to claim 1, wherein the channel extends through the outer surface of the buoyant shell via a sidewall thereof and the buoyant shell includes a scalloped portion such that an end of a pendant line exiting the chamber through the channel hangs away from the sidewall of the buoyant shell when the pendant line is fully taken up.

16. The apparatus according to claim 1, wherein the channel extends through the outer surface of the buoyant shell via a top wall thereof and wherein the top wall of the buoyant shell is recessed relative to a top edge of the buoyant shell such that an end of a pendant line exiting the chamber through the channel is at least partially below the top edge of the buoyant shell when the pendant line is fully taken up.

17. The apparatus according to claim 1, further comprising a bumper surrounding at least a portion of the buoyant shell.

18. The apparatus according to claim 1, further comprising a dual-headed connector attached to the buoyant shell, the connector including a first head positioned within the chamber and configured to receive an end of a pendant line and a second head positioned outside the chamber and configured to receive an end of a mooring line.

19. The apparatus according to claim 18, wherein at least one of the first head and the second head can swivel about a longitudinal axis of the dual-headed connector.

20. A system for mooring a vessel comprising:

a mooring buoy comprising:

a buoyant shell defining a chamber and having a channel extending from the chamber through an outer surface of the buoyant shell;

a rotating takeup/payout device positioned within the chamber and mounted to rotate about a drive axle; and a drive mechanism coupled to the rotating takeup/payout device, wherein the drive mechanism is operable to drive the rotating takeup/payout device to rotate about the drive axle in a first direction while permitting the rotating takeup/payout device to rotate about the drive axle in a second direction opposite the first direction; and a pendant line having a first end attached to the buoyant shell, a length extending through the rotating takeup/payout device and the channel, and a second, free end outside the channel configured to attach to a vessel, wherein, when the pendant line is paid out under tension, the drive mechanism stores potential energy, and wherein, when the pendant line is slack, the drive mechanism releases the stored potential energy to drive the rotating takeup/payout device to rotate in a direction that takes up pendant line.

21. The system according to claim 20, wherein the pendant line is swivelably attached to the buoyant shell.

22. The system according to claim 21, further comprising:

a mooring anchor; and a mooring line coupling the mooring anchor to the mooring buoy.

23. The system according to claim 20, wherein the drive mechanism comprises a power spring.

24. The system according to claim 20, wherein the drive mechanism comprises a counterweight.

25. A vessel mooring apparatus, comprising:

a buoyant shell defining a chamber and having a channel extending from the chamber through an outer surface of the buoyant shell, wherein the channel is configured to accommodate a pendant line therethrough;

a rotating takeup/payout device located within the chamber and mounted to rotate about a drive axle in a first direction corresponding to pendant line takeup and a second, opposite direction corresponding to pendant line payout; and a drive mechanism coupled to the rotating takeup/payout device, wherein the drive mechanism stores energy when the rotating takeup/payout device rotates in the second direction to payout pendant line under tension and utilizes the stored energy to drive the rotating takeup/payout device in the first direction to take up pendant line slack.

26. A vessel mooring apparatus, comprising:

a buoyant shell defining a chamber and having a channel extending from the chamber through an outer surface of the buoyant shell, wherein the channel is configured to accommodate a pendant line therethrough;

a rotating takeup/payout device positioned within the chamber and mounted to rotate about a drive axle; and a drive mechanism coupled to the rotating takeup/payout device, wherein the drive mechanism is operable to drive the rotating takeup/payout device to rotate about the drive axle in a first direction in order to take up pendant line slack while permitting the rotating takeup/payout device to rotate about the drive axle in a second direction opposite the first direction in order to pay out pendant line under tension, wherein the drive mechanism comprises:

a rotating ratchet gear coupled to the rotating takeup/payout device such that the rotating takeup/payout device rotates with the rotating ratchet gear and including a plurality of teeth;

a pendulum having an upper end and a weighted lower end; and a pawl coupled to the upper end of the pendulum and configured to be alternately engaged with and disengaged from the teeth of the rotating ratchet gear, wherein the teeth of the rotating ratchet gear are oriented such that, when the pawl is engaged with the teeth of the rotating ratchet gear, pendulum motion causes the rotating ratchet gear to drive the rotating takeup/payout device in the first direction.

27. The apparatus according to claim 26, wherein the drive mechanism further comprises a tripping mechanism configured to disengage the pawl from the rotating ratchet gear when a pendant line attached to the rotating takeup/payout mechanism has been fully taken up and to reengage the pawl with the rotating ratchet gear when the pendant line is fully paid out under tension.

28. The apparatus according to claim 26, wherein the drive mechanism further comprises a tripping mechanism configured to disengage the pawl from the rotating ratchet gear when a pendant line attached to the rotating takeup/payout mechanism is under tension and to reengage the pawl with the rotating ratchet gear when the pendant line is slack.

* * * * *